US010979804B2

(12) United States Patent
Demer et al.

(10) Patent No.: US 10,979,804 B2
(45) Date of Patent: Apr. 13, 2021

(54) WATERPROOF SPEAKER SYSTEM

(71) Applicant: Southern Ground Artist, Inc., Peachtree City, GA (US)

(72) Inventors: James Demer, Falmouth, ME (US); Jayson Lobozzo, Cape Elizabeth, ME (US); Robb McCollough, West Wyoming, PA (US)

(73) Assignee: Southern Ground Artist, Inc., Peachtree City, GA (US)

( * ) Notice: Subject to any disclaimer, the term of this patent is extended or adjusted under 35 U.S.C. 154(b) by 0 days.

(21) Appl. No.: 16/799,103

(22) Filed: Feb. 24, 2020

(65) Prior Publication Data

US 2020/0275198 A1 Aug. 27, 2020

Related U.S. Application Data

(60) Provisional application No. 62/810,641, filed on Feb. 26, 2019.

(51) Int. Cl.

| | |
|---|---|
| ***B65D 1/24*** | (2006.01) |
| ***H04R 1/44*** | (2006.01) |
| ***H04R 1/02*** | (2006.01) |

(52) U.S. Cl.

CPC ..... *H04R 1/44* (2013.01); *H04R 1/025* (2013.01); *H04R 2400/11* (2013.01)

(58) Field of Classification Search

CPC ..... A47C 7/628; A47C 7/407; A01K 97/22; A45C 13/28

See application file for complete search history.

(56) References Cited

U.S. PATENT DOCUMENTS

| | | | | |
|---|---|---|---|---|
| 4,700,395 | A * | 10/1987 | Long | A45C 11/20 381/334 |
| 4,871,079 | A * | 10/1989 | Doucette | A45C 11/22 220/560 |
| 2006/0223394 | A1 | 10/2006 | Porat | |
| 2015/0096828 | A1 | 4/2015 | Fathollahi | |
| 2015/0225041 | A1* | 8/2015 | Lovett | A43B 7/144 441/21 |

(Continued)

OTHER PUBLICATIONS

The International Search Report/Written Opinion released for corresponding International Patent Application No. PCT/US2020/019442 dated Jun. 15, 2020; 7 pages.

(Continued)

*Primary Examiner* — Amir H Etesam

(74) *Attorney, Agent, or Firm* — Smith Gambrell & Russell LLP

(57) ABSTRACT

The waterproof and dustproof speaker system includes a base with four base sides defining a base internal space. The base internal space can accommodate various items. A passive acoustical radiator is mounted in two opposing sides. A lid is hinged to the base and includes lid sides defining a lid internal space and two speakers mounted in the lid. The lid also accommodates electronics for receiving audio program signals and driving the speakers. When the lid is closed onto the base, the internal space is sealed against the intrusion of water and dust. The waterproof speaker system is weighted and balanced so that waterproof speaker system floats upright in water with the lid uppermost.

2 Claims, 15 Drawing Sheets

(56) References Cited

U.S. PATENT DOCUMENTS

2018/0038624 A1* 2/2018 Huish ..... F25D 3/08

OTHER PUBLICATIONS

Siler, Wes,"The Ruggedest Speaker Also Has the Biggest Sound" found at https://www.outsideonline.com/2243606/ruggedest-speaker-also-has-biggest-sound; Sep. 27, 2017; 5 pages.
GraceDigital, "EcoExtreme" gracedigital.com, found at http://gracedigital.com/shop/ecoextreme; Dec. 23, 2016; entire document, 4 pages.
Amazon.com, "Drytunes Waterproof Bluetooth Speaker with Internal Dry Storage"; found at https://www.amazon.com/Drytunes-Waterproof-Bluetooth-Speaker-Internal/dp/B00M396GBI; Jun. 24, 2014; entire document, 2 pages.

* cited by examiner

WATERPROOF SPEAKER SYSTEM

CLAIM OF PRIORITY

This application claims priority from U.S. Provisional Patent Application Ser. No. 62/810,641, filed on Feb. 26, 2019, which is incorporated herein in its entirety.

FIELD OF THE INVENTION

This invention relates to a waterproof and dustproof speaker system for reproducing sound from digital sound files.

BACKGROUND OF THE INVENTION

With the advent of portable devices, such as smart phones, capable of storing large lists of music, a need exists for a portable speaker system that can produce quality sound reproduction. Furthermore, such a speaker system should be capable of functioning in environments in which water and/or dust are present.

SUMMARY OF THE INVENTION

The present invention addresses the issues raised by the need for a portable speaker system capable of playing music from an external portable device, such as a smart phone, while being capable of functioning in an environment in which water and/or dust is present.

Particularly, the present invention comprises a waterproof and dustproof carrying case in which waterproof speakers are mounted. The carrying case protects the internal electronics required to stream audio from the external portable device and provides a waterproof space for carrying items such as food, drinks, personal effects, etc.

In addition, the volume of the internal space of the carrying case of the present invention provides a resonance chamber for the speakers. Passive audio radiators are employed in the sides of the carrying case to enhance the sound quality produced by the waterproof speakers.

The portable carrying case of the waterproof speaker system is dimensioned and balanced so that when dropped in a body of water, the waterproof speaker system floats with the waterproof speakers oriented upward, on top of the carrying case, and out of the water.

Further objects, features and advantages will become apparent upon consideration of the following detailed description of the invention when taken in conjunction with the drawings and the appended claims.

DETAILED DESCRIPTION OF THE PREFERRED EMBODIMENTS

Figure 1:
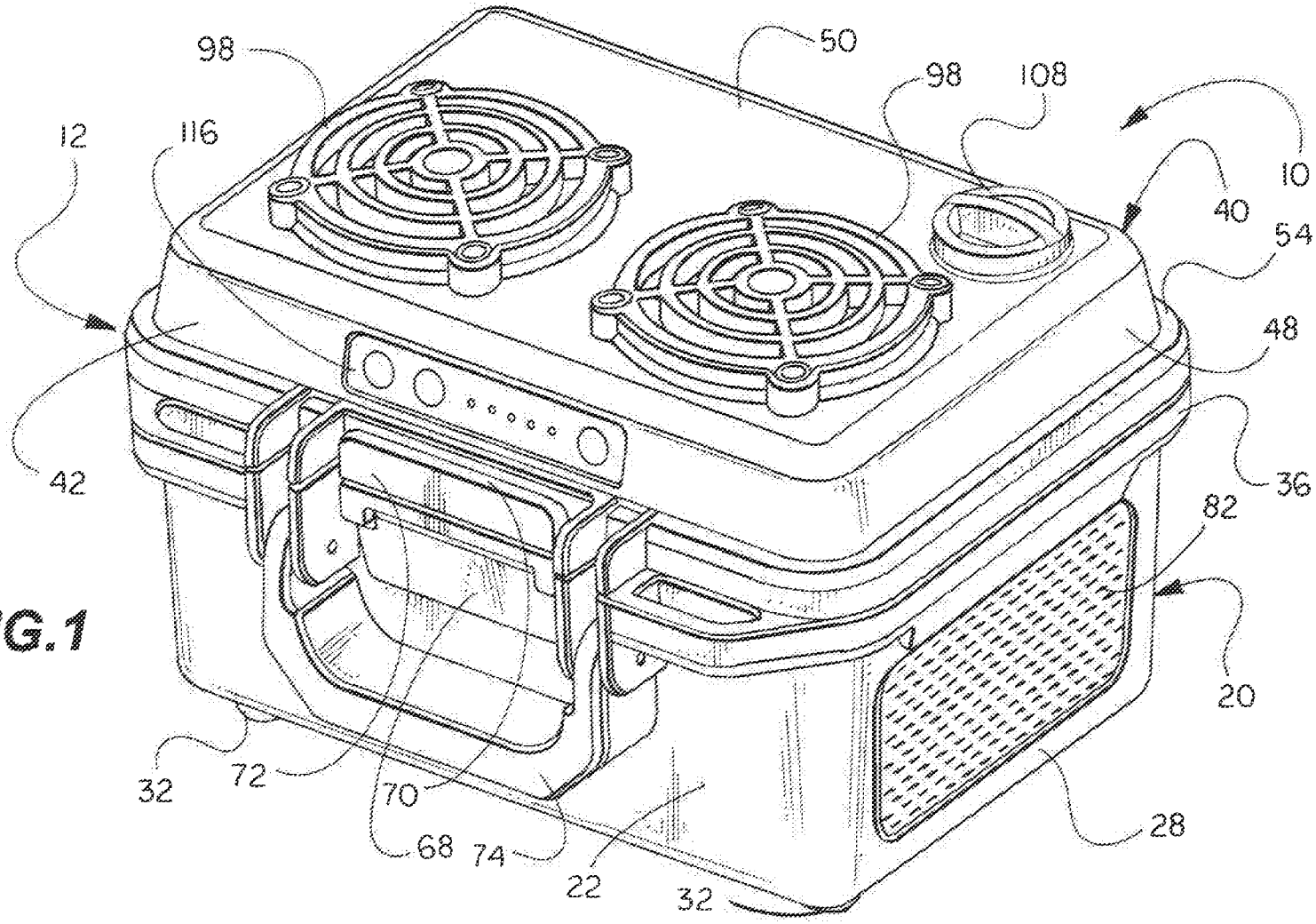
FIG. 1 is a front perspective view of a waterproof and dustproof speaker system in accordance with the present invention.
Figure 2:
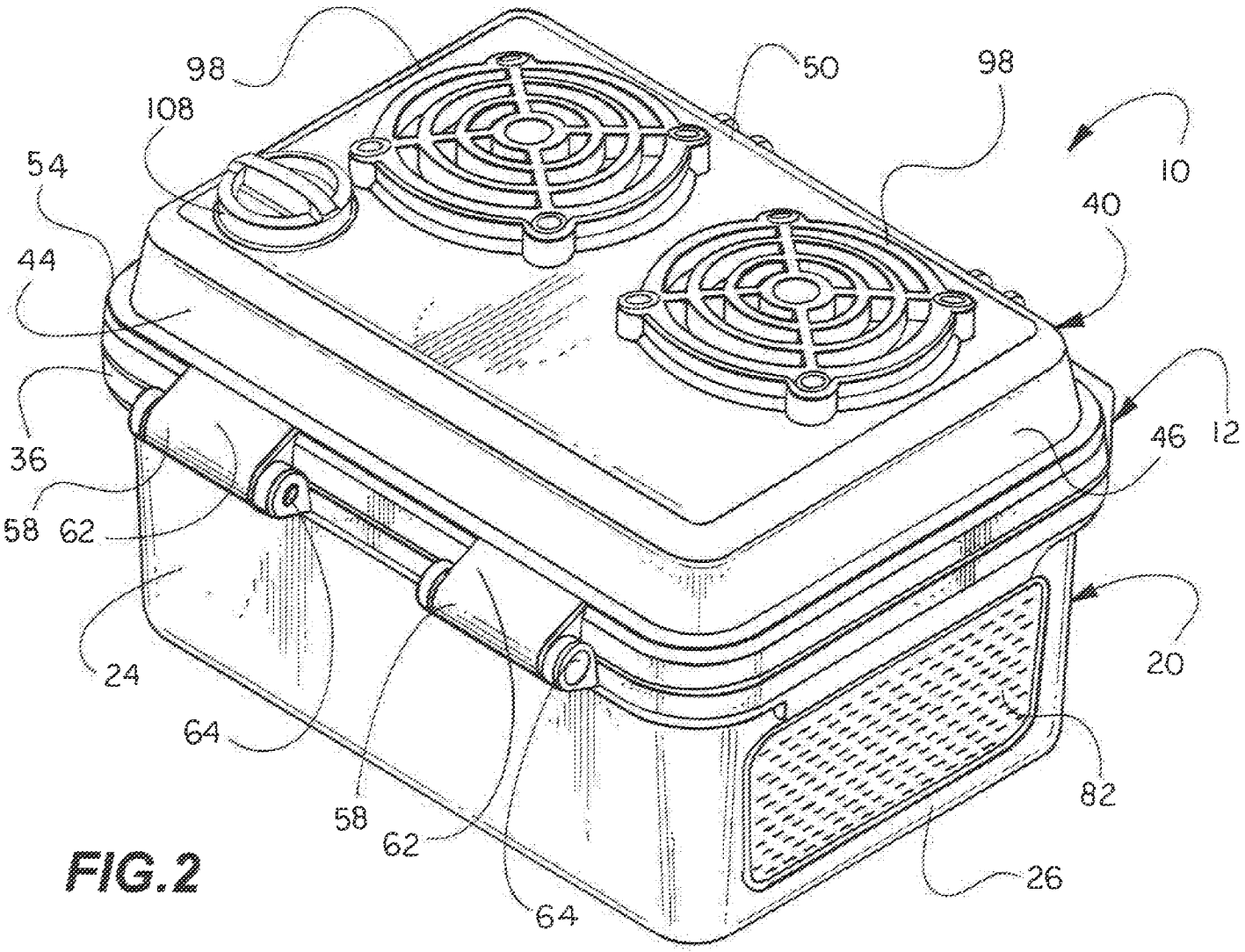
FIG. 2 is a back perspective view of the waterproof and dustproof speaker system in accordance with the present invention.
Figure 3:
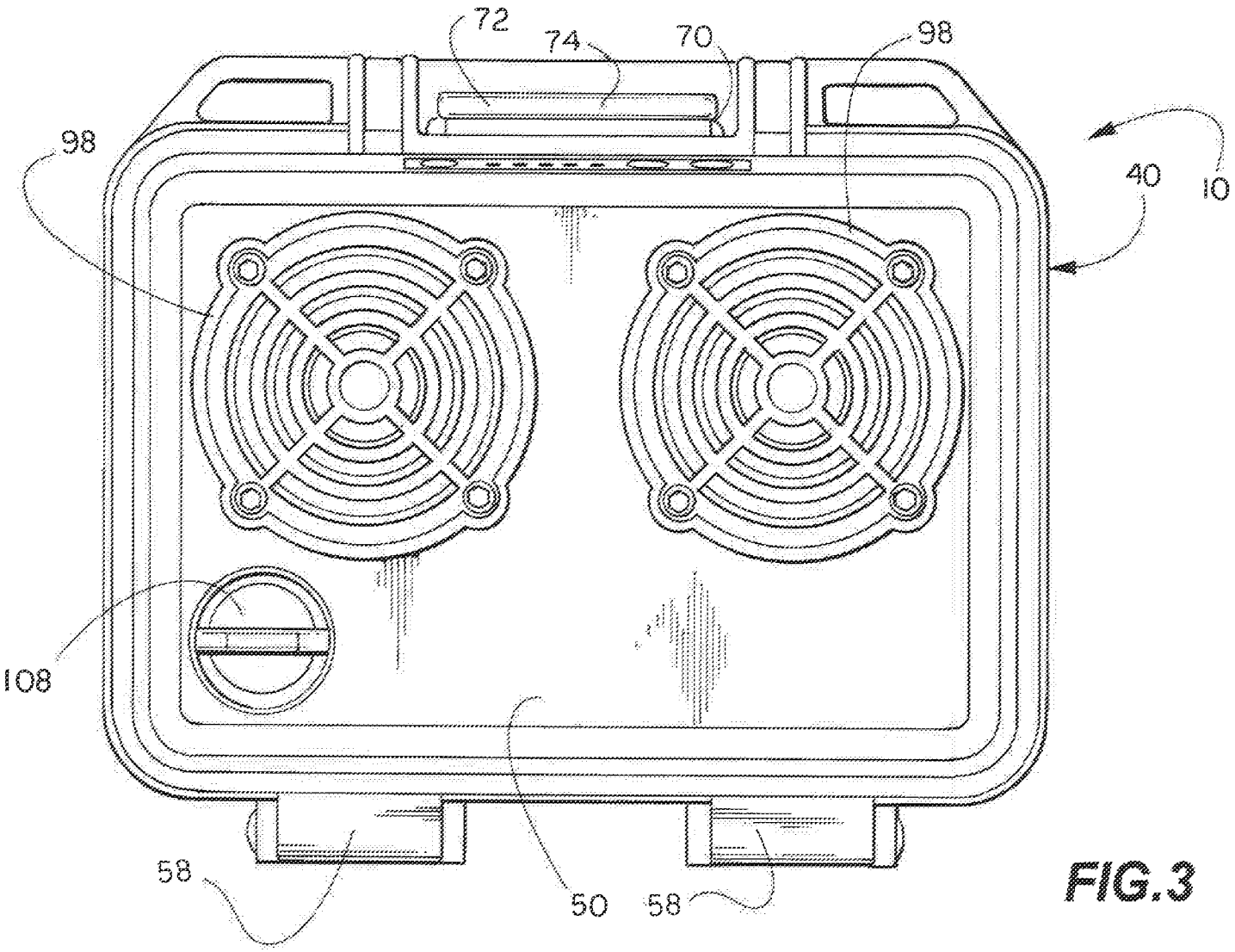
FIG. 3 is a top plan view of the waterproof and dustproof speaker system in accordance with the present invention.
Figure 11:
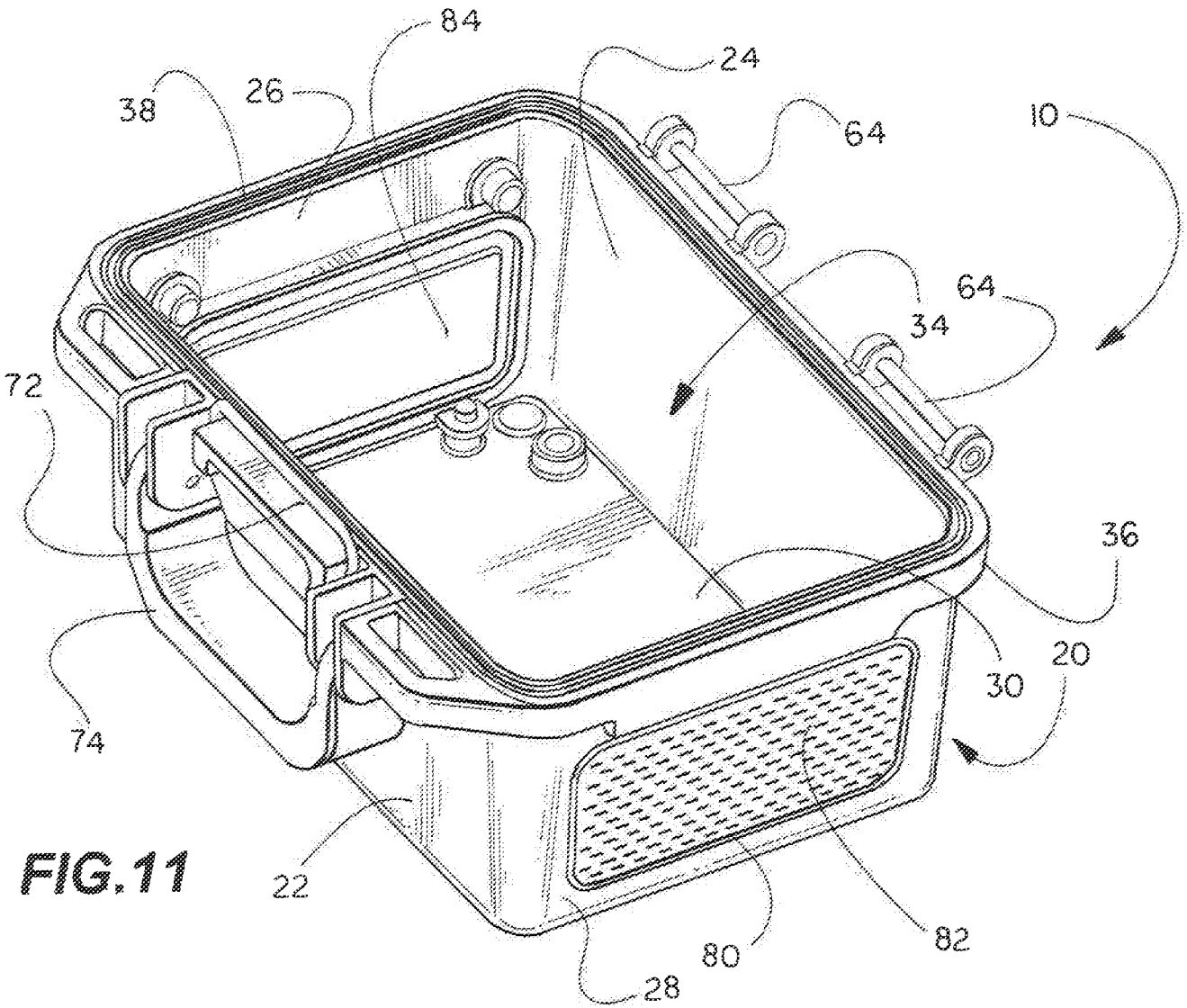
FIG. 11 is a front perspective view of the waterproof and dustproof speaker system with the lid removed to expose internal detail of the base of the waterproof and dustproof speaker system in accordance with the present invention.
Figure 12:
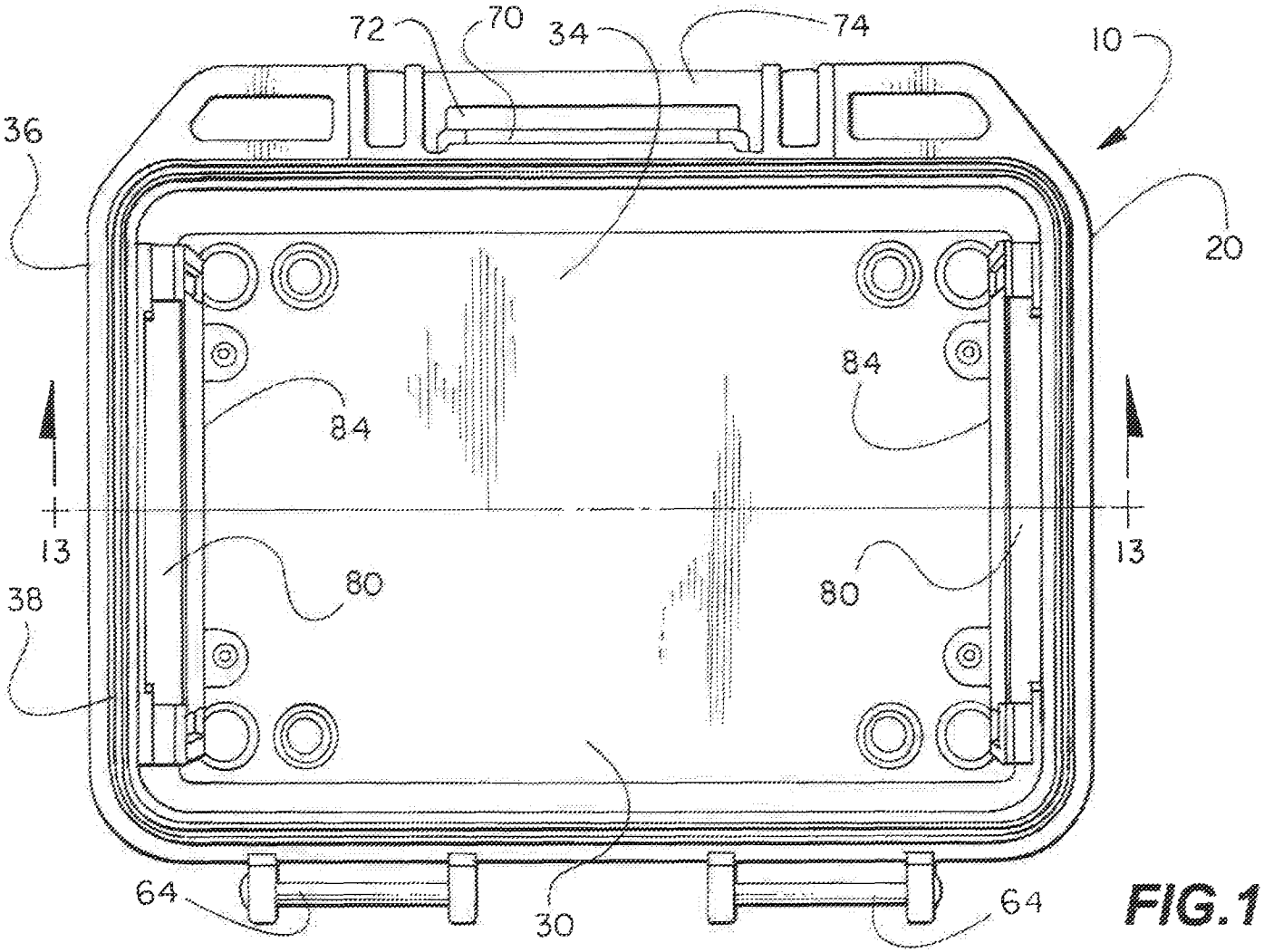
FIG. 12 is a top plan view of the waterproof and dustproof speaker system with the lid removed to expose internal detail of the base of the waterproof and dustproof speaker system in accordance with the present invention.
Figure 13:
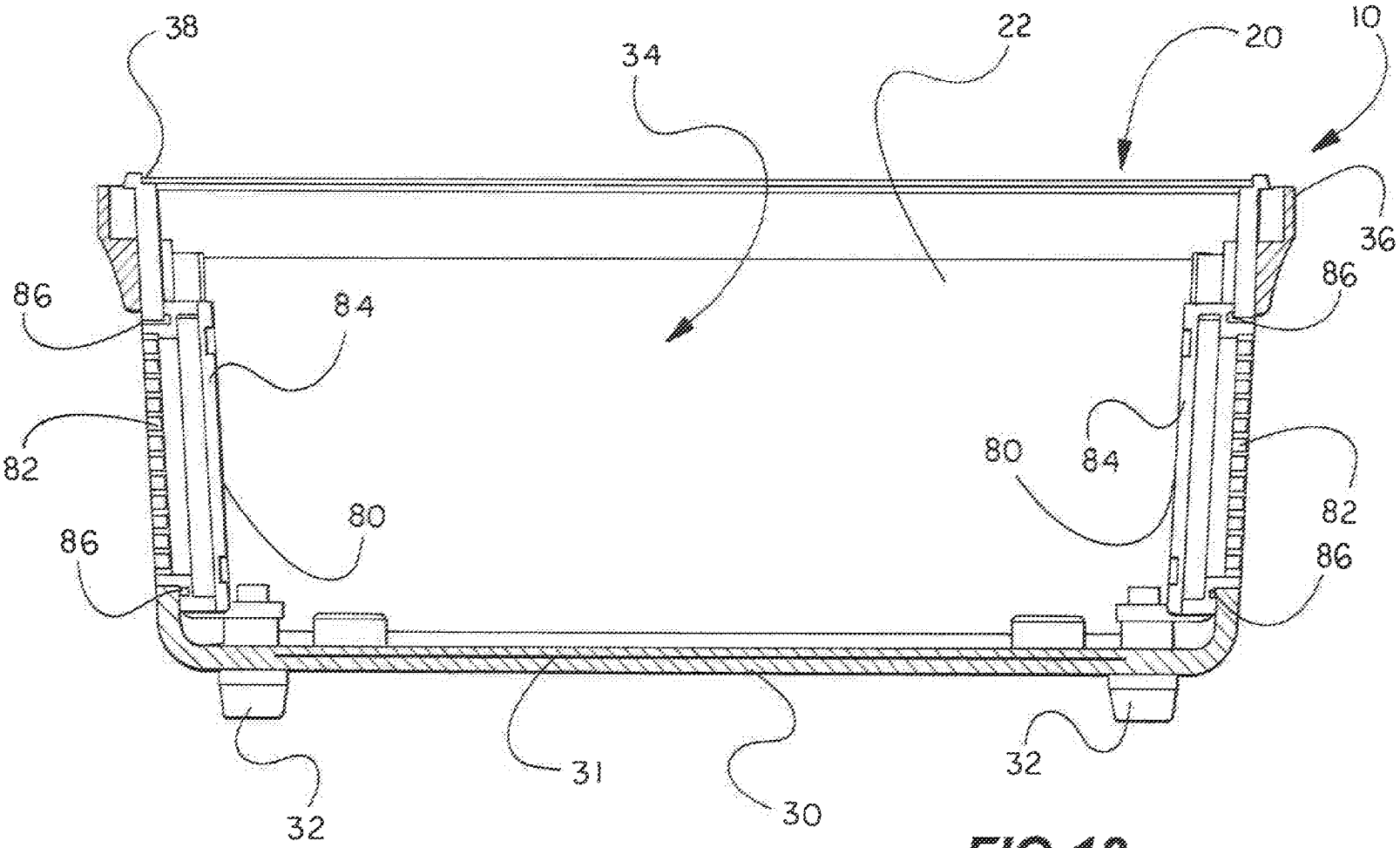
FIG. 13 is a section view of the waterproof and dustproof speaker system with the lid removed to expose internal detail of the base of the waterproof and dustproof speaker system in accordance with the present invention as seen along the line 13-13 of FIG. 12.

Turning to the figures, a waterproof and dustproof speaker system 10 comprises speakers 100 (FIG. 15) and a carrying case 12. The carrying case 12 comprises a base 20 and a lid 40. The base 20 includes a base front 22, a base back 24, a base left side 26, a base right side 28, and a base bottom 30, which together define a base internal space 34 (FIG. 1). Nonskid rubber feet 32 for supporting the base are attached to the external surface of the base bottom 30. The base 20 has an upper rim 36 surrounding the top of the internal space 34. A gasket 38 is attached to the upper surface of the upper rim 36 (FIGS. 11-13).

Figure 14:
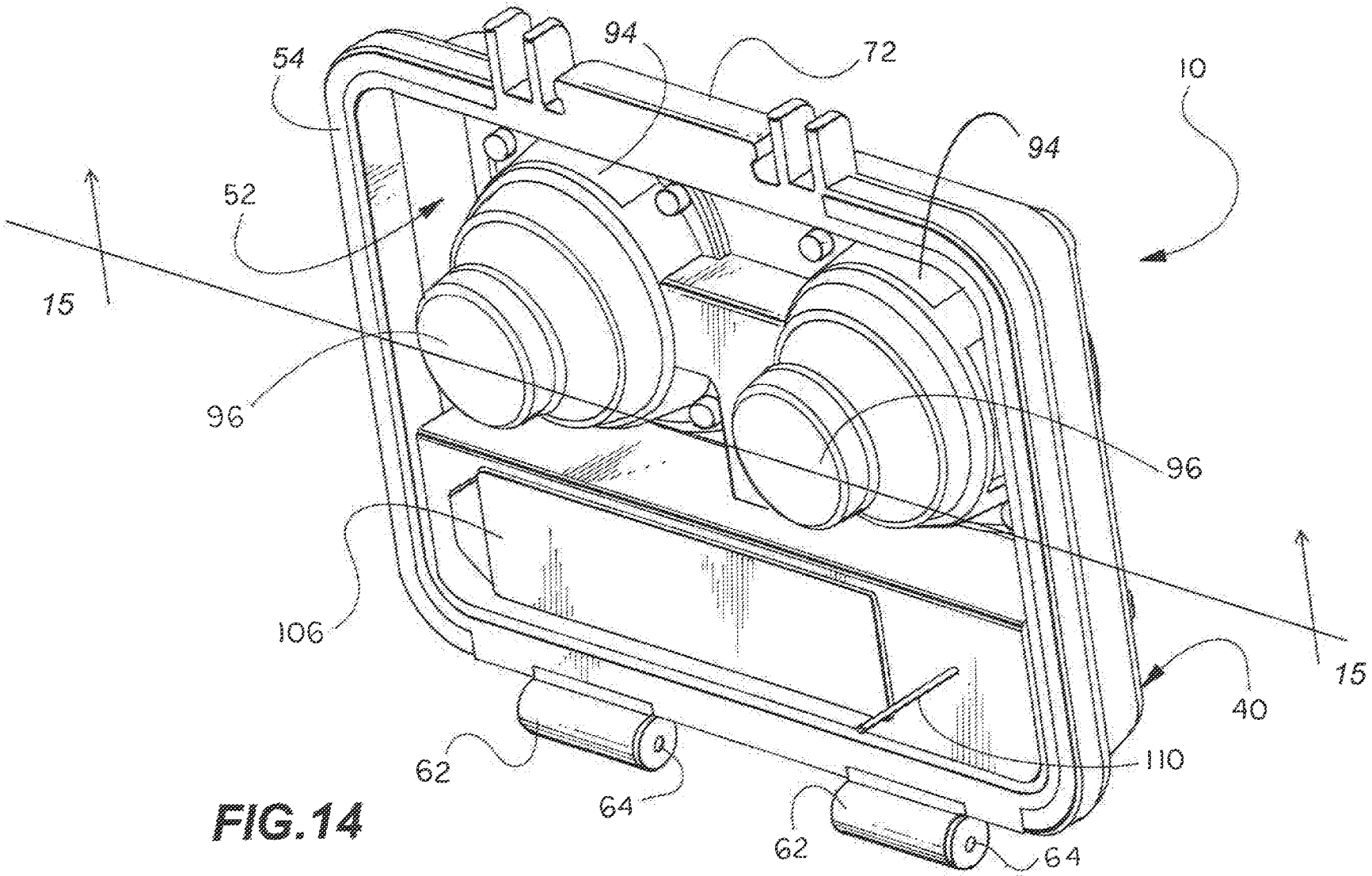
FIG. 14 is a perspective view of the lid of the waterproof and dustproof speaker system in accordance with the present invention.
Figure 15:
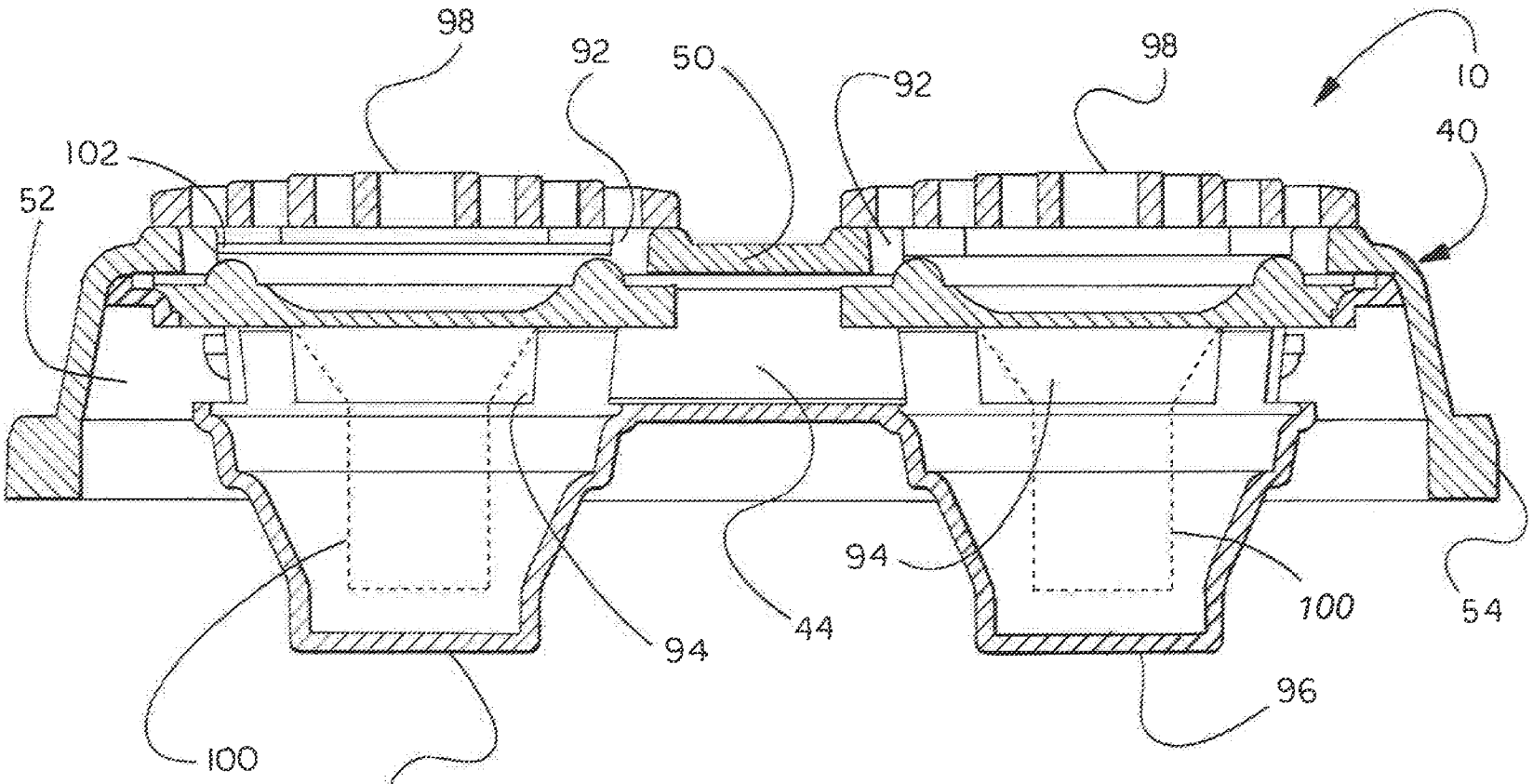
FIG. 15 is a section view of the lid of the waterproof and dustproof speaker system in accordance with the present invention as seen along line 15-15 of FIG. 14.

The lid 40 includes a lid front 42, a lid back 44, a lid left side 46, a lid right side 48, and a lid top 50, which together define a lid internal space 52. The lid 40 has a lower rim 54 surrounding the internal space 52 (FIGS. 14 and 15). Hinges 58 include a base hinge part 60 attached to the base 20, a lid hinge part 62 attached to the lid 40, and a hinge pin 64. The hinge pin 64 connects the base hinge part 60 and the lid hinge part 62. As a result, the hinges 58 connect the lid 40 to the base 20 to allow relative rotating movement between the lid 40 and the base 20 for opening and closing the lid 40. A draw latch 66 includes a latch lever 68 and a latch loop 70 attached to the base 20 and a latch strike 72 attached to the lid 40. The draw latch 66 is configured to securely draw the rim 54 of the lid 40 against the gasket 38 of the rim 36 of the base 20 in order to provide a waterproof and dustproof seal between the rim 36 of the base 20 and the rim 54 of the lid 40 and thus render the internal spaces 34 and 52 waterproof and dustproof.

The internal space 34 of the base 20 of the waterproof speaker system 10 has room for storing and carrying items such as food, drink, personal effects, etc. To ensure that the internal spaces 34 and 52 of the waterproof speaker apparatus 10 remains dry, any wet items such as ice is contained in an auxiliary pouch (not shown).

Figure 4:
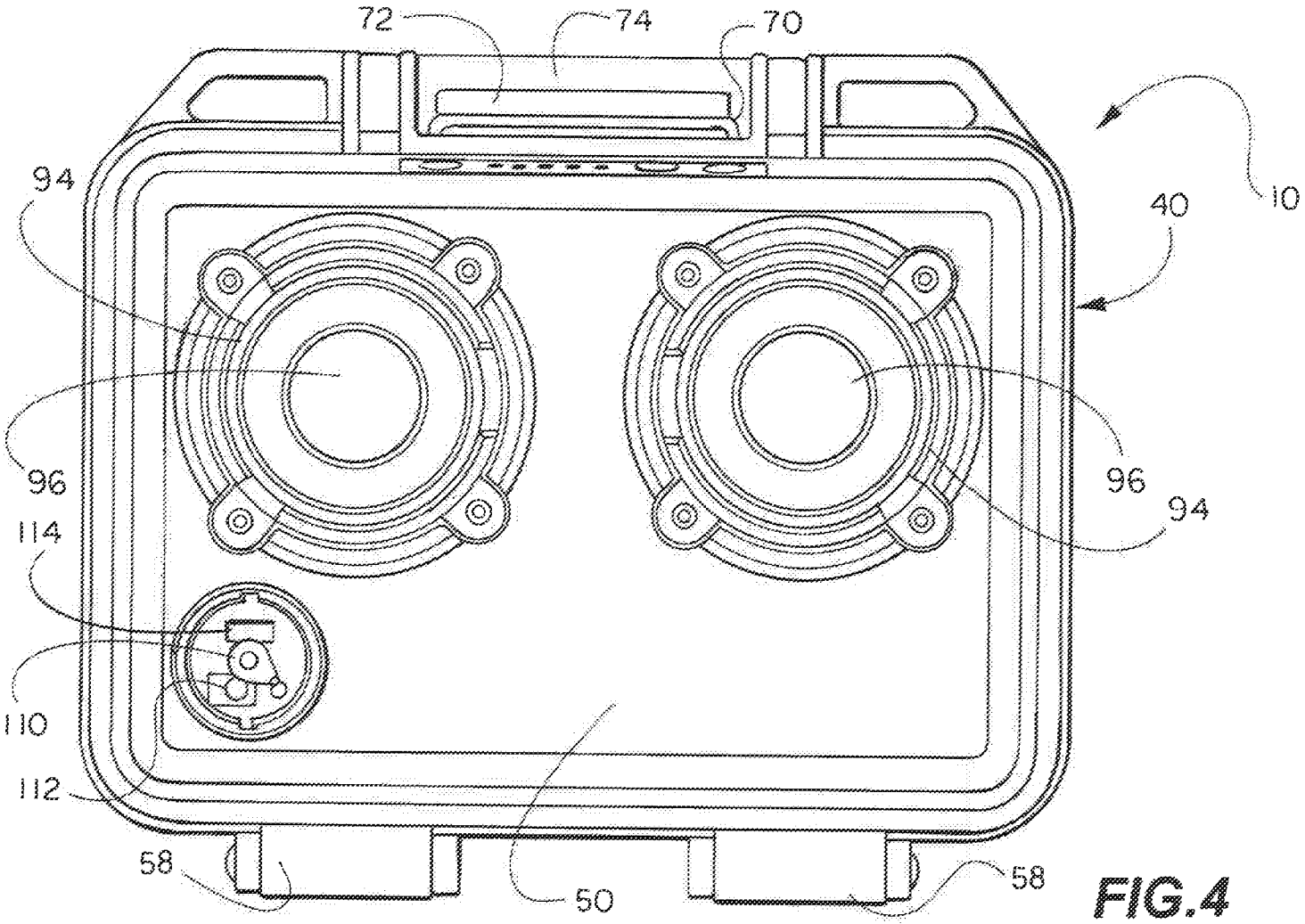
FIG. 4 is a top plan view of the waterproof and dustproof speaker system with the access plug and the speaker grills removed for clarity in accordance with the present invention.
Figure 5:
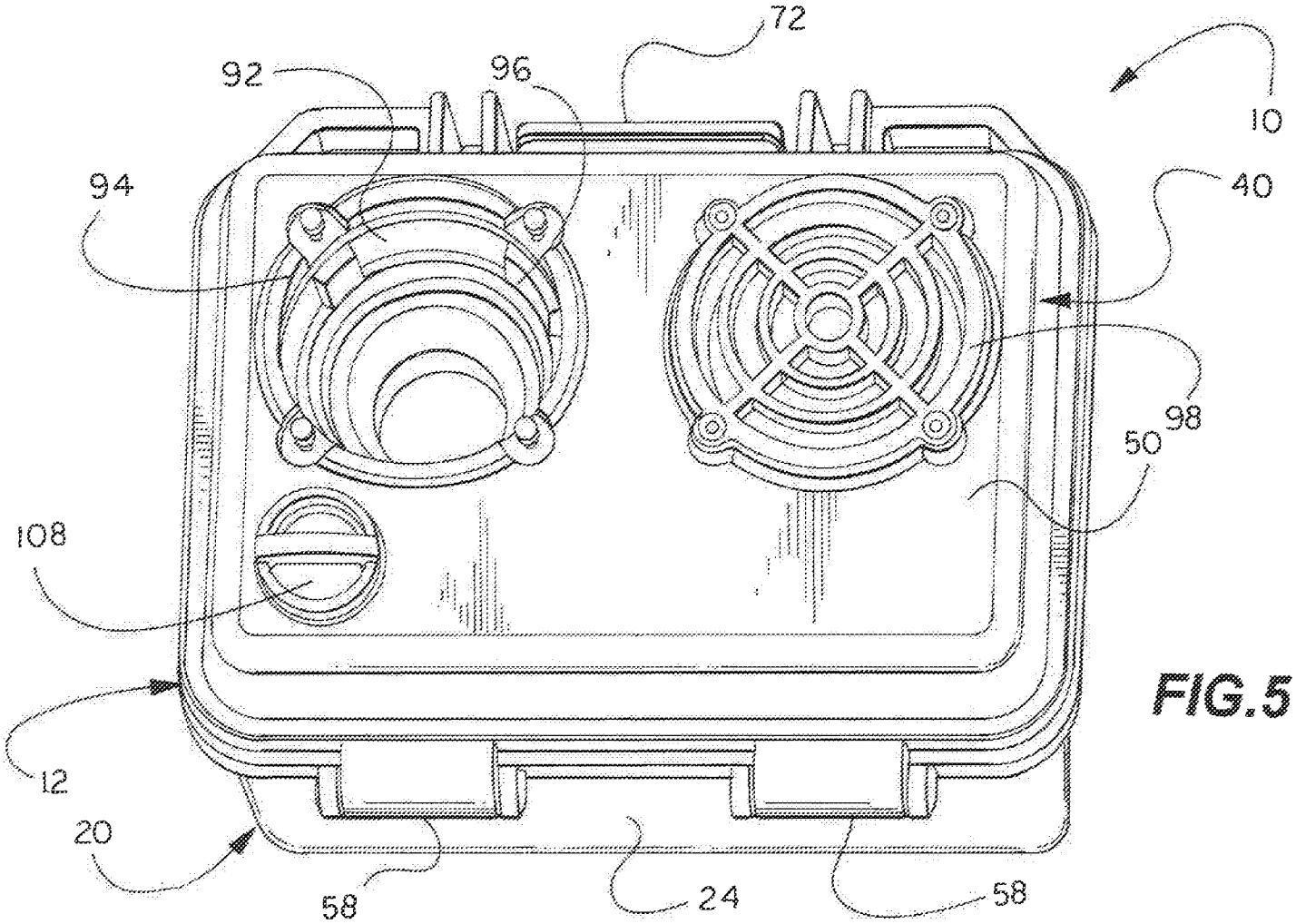
FIG. 5 is a top perspective view of the waterproof and dustproof speaker system with one of the speakers removed to expose internal detail in accordance with the present invention.
Figure 6:
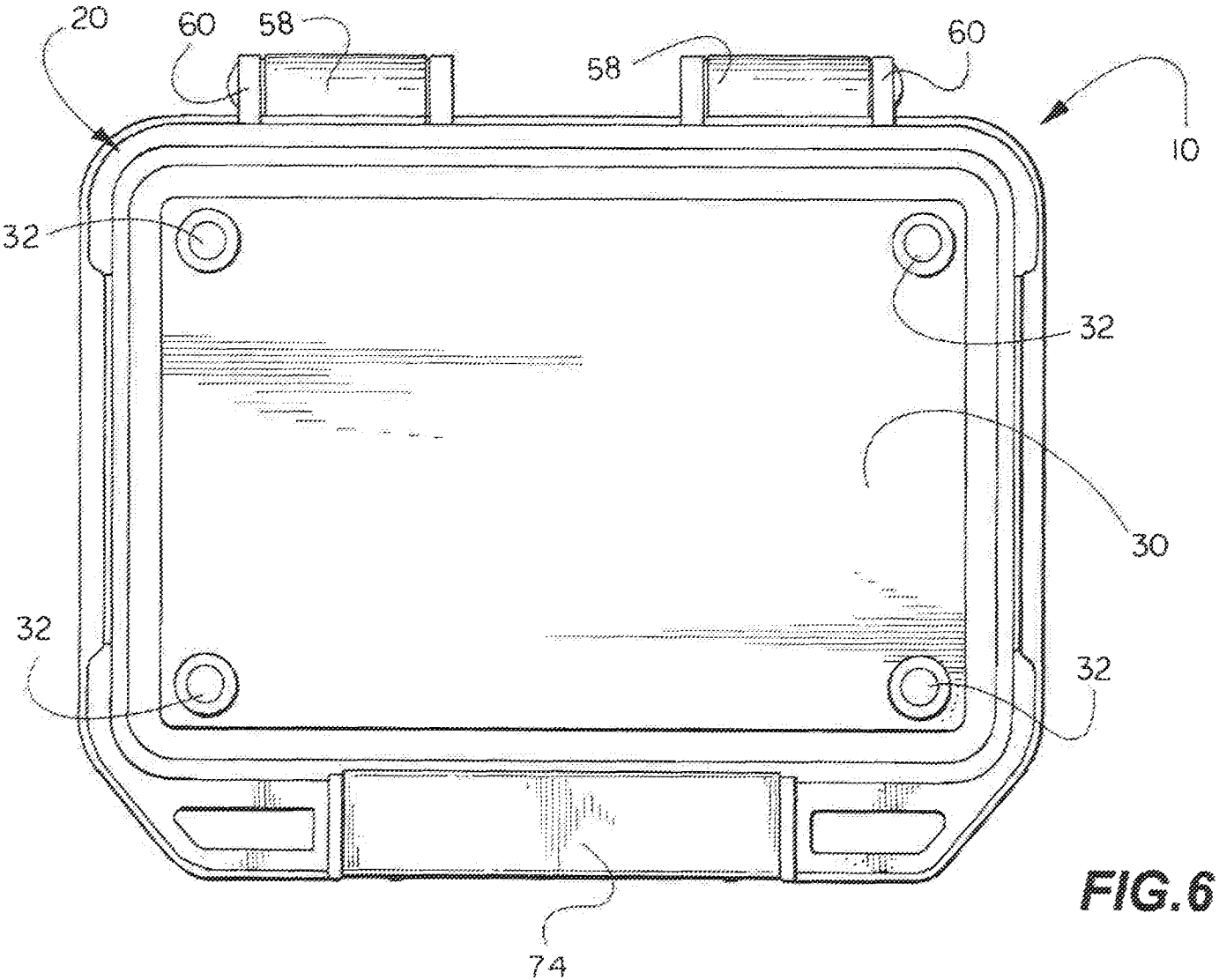
FIG. 6 is bottom plan view of the waterproof and dustproof speaker system in accordance with the present invention.
Figure 7:
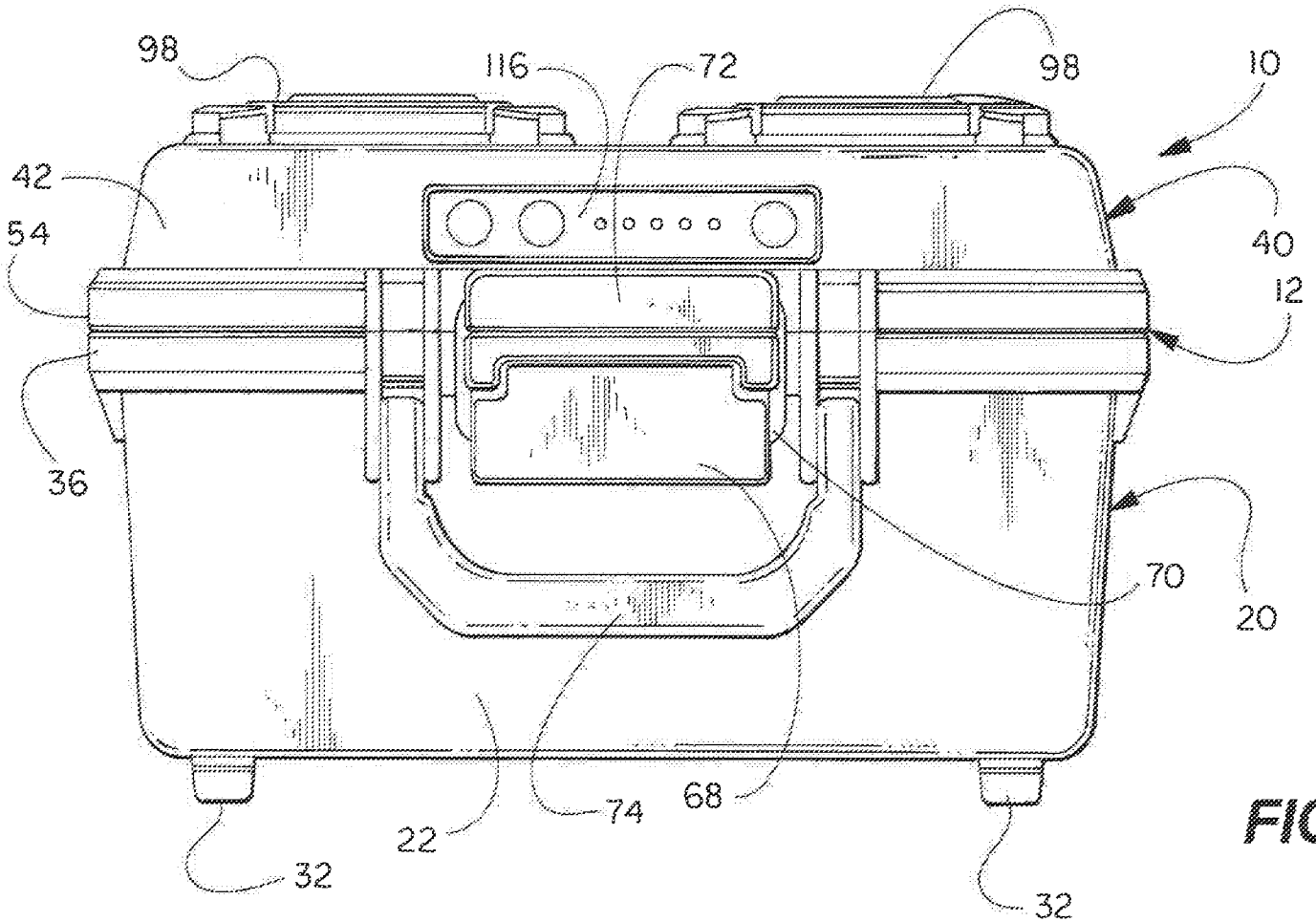
FIG. 7 is a front elevation view of the waterproof and dustproof speaker system in accordance with the present invention.
Figure 8:
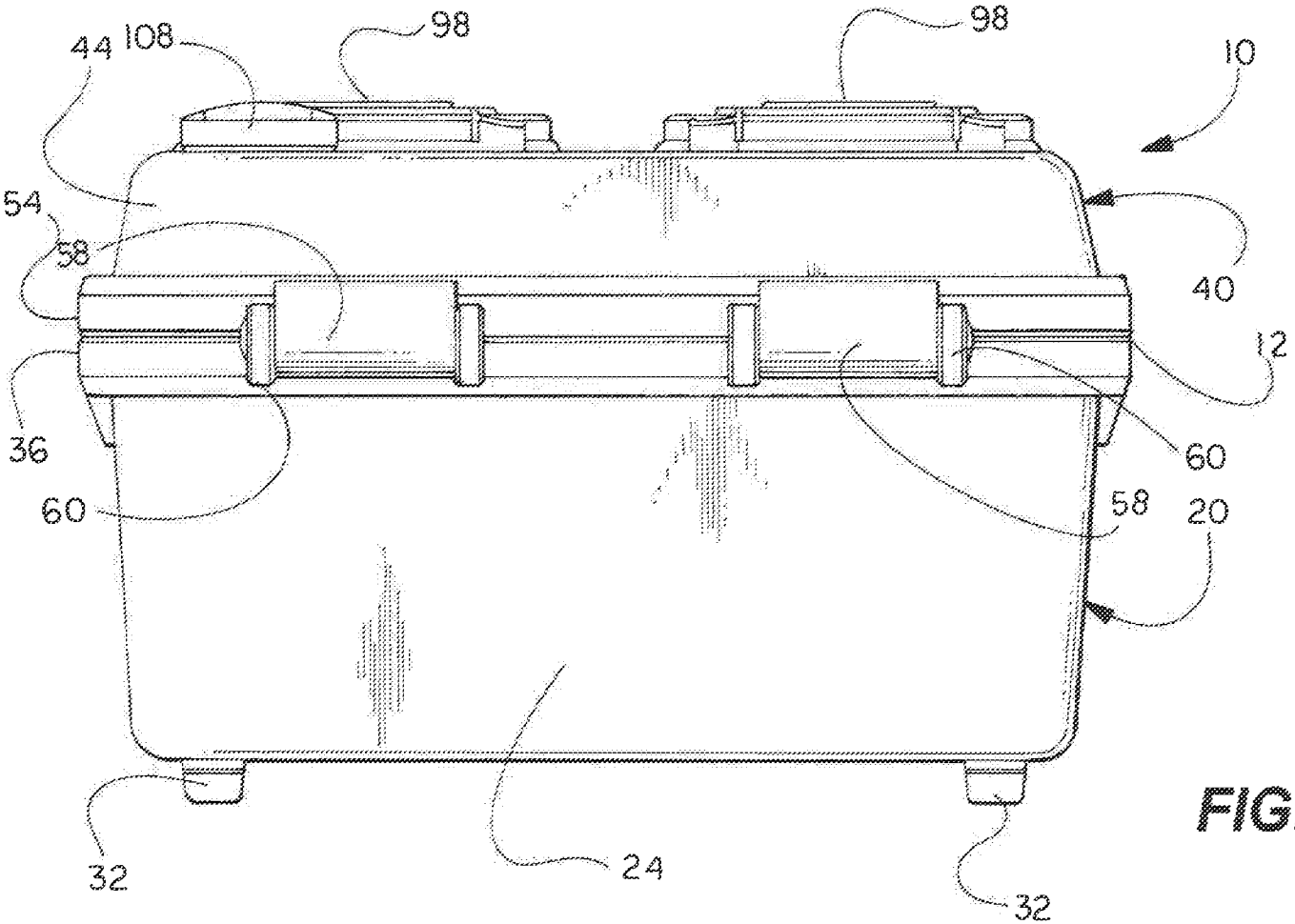
FIG. 8 is a back elevation view of the waterproof and dustproof speaker system in accordance with the present invention.
Figure 9:
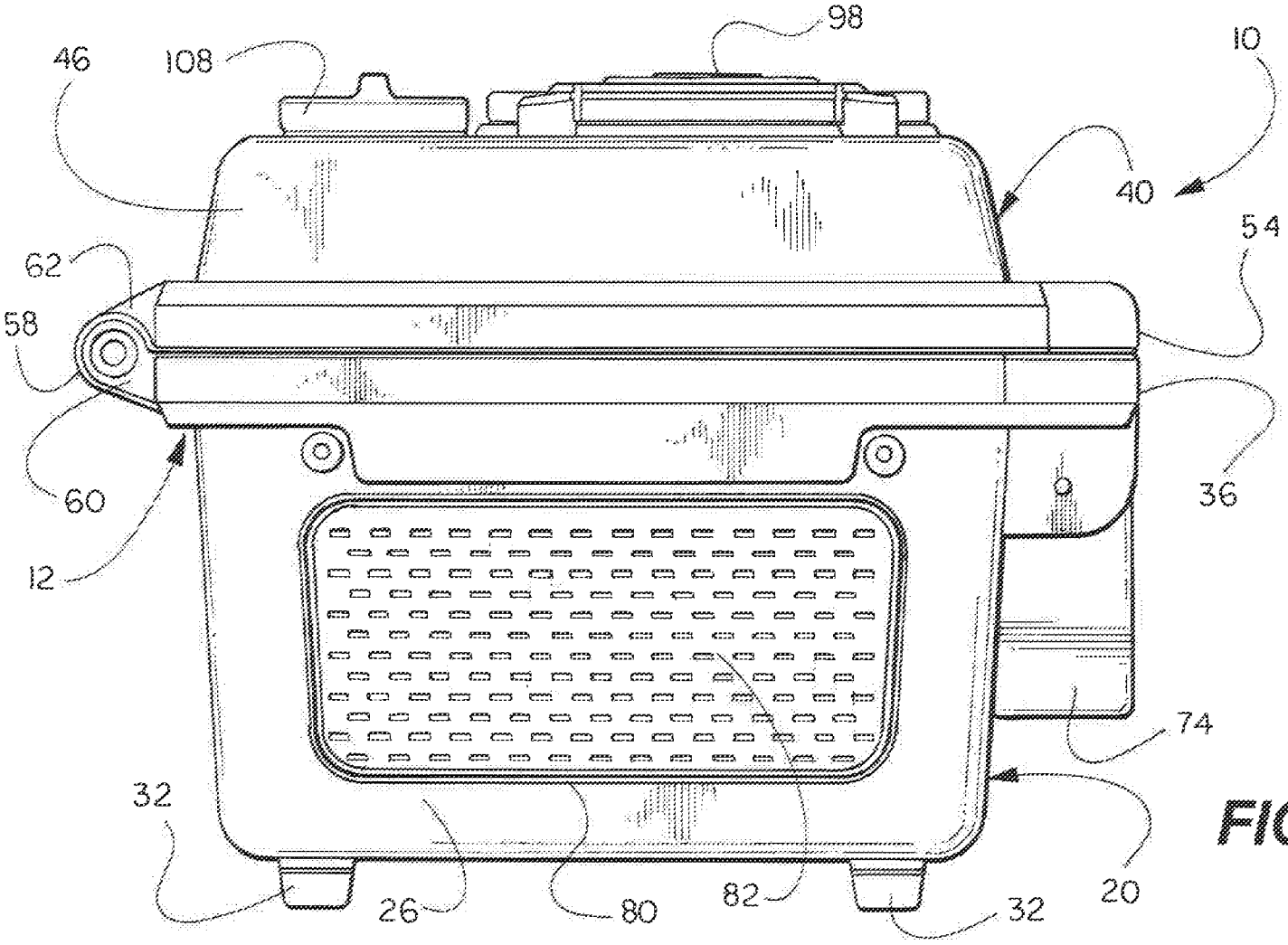
FIG. 9 is a left side elevation view of the waterproof and dustproof speaker system in accordance with the present invention.
Figure 10:
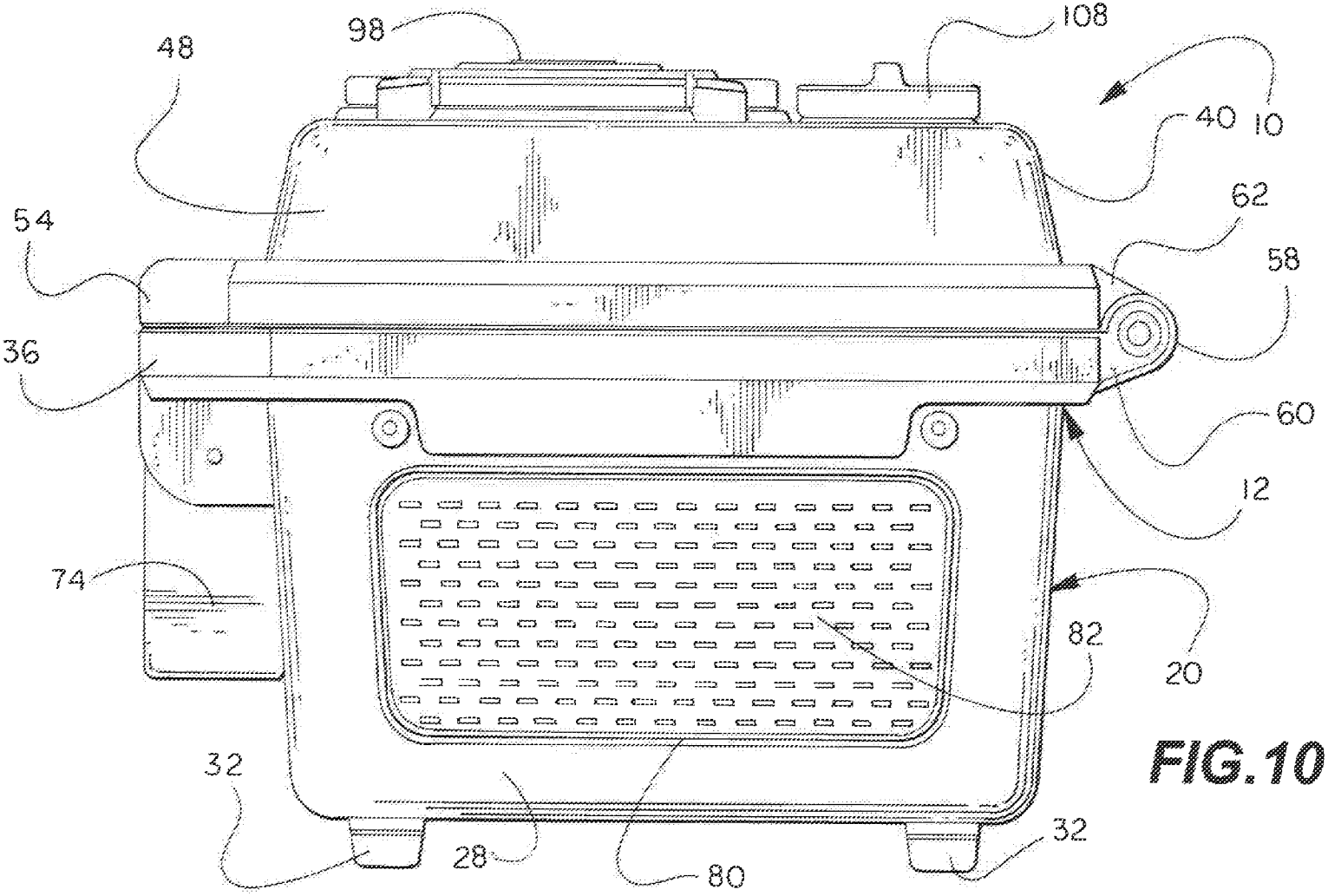
FIG. 10 is a right side elevation view of the waterproof and dustproof speaker system in accordance with the present invention.

The internal space 34 of the base 20 also accommodates passive audio radiators 80 in the left side wall 26 and the right side wall 28 of the base 20. Each passive audio radiator 80 includes an external grill 82 and an internal back plate 84. The external grill 82 includes a series of openings. The back plates 84 are attached to the internal surfaces of the left side 26 and the right side 28. Back plate gaskets 86 (FIG. 13), interposed between the back plates 80 and the internal surfaces of the left side 26 and the right side 28, serve to maintain the internal space 34 of the base 20 waterproof and dustproof. The back plates 84 of the passive audio radiators 80 resonate with the sound waves produced by speakers 100 as described below The lid 40 accommodates the speakers 100 and the electronics for driving the speakers 100. Particularly, the top 50 of the lid 40 has speaker openings 94 (FIGS. 4, 5, and 15). The speakers 100 are waterproof and are mounted in the openings 94. Speaker gaskets 102 seal the waterproof speakers 100 around the openings 94 (FIG. 16). Speaker housings 96 extend from the internal surface of the lid top 50. Each speaker housing 96 surrounds each speaker 100. Housing openings 92 in the speaker housings 96 provide air communication with the internal spaces 34 and 52.

The lid 40 also includes an electronics compartment 106. The electronics compartment 106 accommodates the electronics that drive the speakers including a removable and rechargeable battery as well as the electronics that allow one or more portable electronic devices to pair with the waterproof speaker system 10 by means of a Bluetooth connection. The lid 40 also has an access plug 108 that engages the top 50 of the lid 40 with a bayonet style connector and allows access to a power connector 112 for providing auxiliary power to the electronics and USB port 114 for providing power for other devices as well as communication with other devices (FIG. 4). Both the auxiliary power connector 112 and USB port 114 are waterproof and dustproof, and the access plug 108 also engages the top 50 of the lid 40 in a waterproof and dustproof manner. The access plug 108 is attached to a tether 110 (FIGS. 4 and 14) in order to assure that the access plug is not lost when removed.

The lid 40 includes control panel 116 that allows the user to control the speakers and the connection from external devices. A Qualcomm Bluetooth chip is used to provide multi pairing between the internal electronics of the speaker system 10 and the external source device.

The base 20 and the lid 40 are constructed of polypropylene reinforced with fiberglass so that the carrying case 12 of the waterproof and dustproof speaker system 10 will withstand a drop test in accordance with Mil Spec 810G. Moreover, the carrying case 12 of the waterproof and dustproof speaker system 10 has a waterproof rating such that the carrying case 12 of the speaker system 10 will protect against jets of water with limited ingress of water permitted. Moreover, the carrying case 12 of the waterproof and dustproof speaker system 10 is dust tight with no ingress of dust permitted. The carrying case is a dust/waterproof rating of IP67.

Finally, the waterproof and dustproof speaker system 10 is dimensioned and balanced so that when dropped into a body of water, the waterproof and dustproof speaker system 10 will float to its upright position with the speaker grills 98 facing upward and out of the water. Particularly, a metal plate ballast 31 is molded into the plastic bottom 30 (FIG. 13). The metal plate 31 offsets the weight of the electronics, battery, and speakers, in the top of the waterproof speaker system 10 and thereby serves as ballast to keep the waterproof and dustproof speaker system 10 floating upright. Alternatively, the metal plate or other weighted material could be attached externally to the plastic bottom 30.

While this invention has been described with reference to preferred embodiments thereof, it is to be understood that variations and modifications can be affected within the spirit and scope of the invention as described herein and as described in the appended claims.

We claim:

1. A speaker system comprising:

a. a base with a base front, a base back, a base bottom, and base sides defining a base internal space, each base side including at least one passive acoustical radiator, the at least one passive acoustical radiator is sealed to each base side to preclude intrusion of water or dust; and b. a lid hinged to the base and including a lid front, a lid back, a lid top, and lid sides defining a lid internal space, the lid including:

i. at least one speaker mounted in the lid top and sealed to the lid top to preclude intrusion of water or dust, the at least one speaker capable of radiating sound into the base internal space; and ii. electronics mounted in the lid for receiving audio program signals and driving the at least one speaker, wherein when the lid is closed onto the base, the lid seals the base from the intrusion of water or dust.

2. The speaker system of claim 1, wherein the base is provided with ballast so that the speaker system floats in water in a position with the lid uppermost.

* * * * *